US009528239B2

(12) United States Patent
Nakayasu et al.

(10) Patent No.: US 9,528,239 B2
(45) Date of Patent: Dec. 27, 2016

(54) FLOATING FLAP GATE

(75) Inventors: Kyouichi Nakayasu, Osaka (JP); Yoshito Yamakawa, Osaka (JP); Toshiaki Morii, Osaka (JP); Masaki Inui, Osaka (JP); Yuuichirou Kimura, Osaka (JP)

(73) Assignee: Hitachi Zosen Corporation, Osaka (JP)

( * ) Notice: Subject to any disclaimer, the term of this patent is extended or adjusted under 35 U.S.C. 154(b) by 253 days.

(21) Appl. No.: 14/118,830

(22) PCT Filed: Apr. 2, 2012

(86) PCT No.: PCT/JP2012/058937

§ 371 (c)(1),
(2), (4) Date: Jan. 27, 2014

(87) PCT Pub. No.: WO2012/160877

PCT Pub. Date: Nov. 29, 2012

(65) Prior Publication Data

US 2014/0140770 A1 May 22, 2014

(30) Foreign Application Priority Data

May 20, 2011 (JP) ..... 2011-113767

(51) Int. Cl.
*E02B 7/40* (2006.01)
*E02B 7/02* (2006.01)
(Continued)

(52) U.S. Cl.
CPC ..... *E02B 7/40* (2013.01); *E02B 3/104* (2013.01); *E02B 7/44* (2013.01); *E06B 2009/007* (2013.01)

(58) Field of Classification Search
CPC ..... E02B 7/40; E02B 7/42; E02B 7/44; E02B 7/205; E02B 3/102; E02B 3/104; E06B 2009/007
(Continued)

(56) References Cited

U.S. PATENT DOCUMENTS 1,130,097 A * 3/1915 Meikle ..... E02B 7/205 405/97
1,648,535 A * 11/1927 Broome ..... E02B 7/54 277/641
(Continued)

FOREIGN PATENT DOCUMENTS

JP 62-16123 U 1/1987
JP 6-3959 Y2 4/1988
(Continued)

OTHER PUBLICATIONS

International Search Report for International Application No. PCT/JP2012/058937, dated Jun. 26, 2012, 1 page.
(Continued)

*Primary Examiner* — Frederick L Lagman
*Assistant Examiner* — Stacy Warren
(74) *Attorney, Agent, or Firm* — Brinks Gilson & Lione

(57) ABSTRACT

A floating flap gate to prevent water from overflowing into underground spaces, with ease in raising or lowering the door body when water level changes. The floating flap gate comprises a door body with a forward end which swings upwards or downwards in a same direction following a rise or a drop in water level, wherein an opposite end serves as a fulcrum. A rod is attached to the forward end of the door body. One end of a wire rope is attached to the rod, and the other end is attached to a counterweight via fixed pulleys. The fixed pulleys are arranged so that the counterweight is at its lowest point when the angle of inclination of the door body with respect to a horizontal plane reaches within a range from 10° to 80° during raising or lowering of the door body.

2 Claims, 6 Drawing Sheets

(51) Int. Cl.

| | |
|---|---|
| ***E02B 7/44*** | (2006.01) |
| ***E02B 3/10*** | (2006.01) |
| *E06B 9/00* | (2006.01) |

(58) Field of Classification Search
USPC ..... 405/87, 92, 94, 96, 99–102, 106, 107, 405/109, 113
See application file for complete search history.

(56) References Cited

U.S. PATENT DOCUMENTS 1,886,490 A * 11/1932 Lynch ..... E05D 15/405 160/203
2,699,653 A * 1/1955 Ponsar ..... G05D 9/02 137/403
2,776,541 A * 1/1957 Fortes ..... E02B 7/205 405/95
4,083,150 A * 4/1978 Smith ..... E05F 11/16 49/200

FOREIGN PATENT DOCUMENTS

| | | | |
|---|---|---|---|
| JP | 11-256555 | A | 9/1999 |
| JP | 2000-319857 | A | 11/2000 |
| JP | 2001-214425 | A | 8/2001 |
| JP | 2003-129762 | A | 5/2003 |
| JP | 2003-253912 | A | 9/2003 |
| KR | 10-0532630 | B1 | 12/2005 |

OTHER PUBLICATIONS

International Preliminary Report on Patentability for International Application No. PCT/JP2012/058937, dated Nov. 20, 2013, 5 pages.

* cited by examiner

FLOATING FLAP GATE

TECHNICAL FIELD

The present invention relates to a floating flap gate which is disposed at an opening in a seawall to prevent a rising water from flowing into living spaces or underground spaces at a time of rising water, by raising a door body to block the opening.

BACKGROUND ART

A floating flap gate exists which is disposed at an opening of a seawall and blocks the opening at the time of a rising water to prevent the rising water from flowing into living spaces or underground spaces, by raising a door body, using a buoyancy of the water which is trying to flow in (e.g., Patent Reference 1).

However, the floating flap gate disclosed in Patent Reference 1 has a problem in that if a speed of the inflowing water is high, the rising action of a door body 1 is delayed, resulting in an overflow of water into living spaces or underground spaces (see FIG. 11 (*a*).)

In addition, when the water level drops, the door body 1 stays at a rising state up to a water level which is about ⅓ the height of the door body 1, and subsequently exhibits a hazardous behavior such as suddenly falling (see FIG. 11 (*b*).)

In order to prevent the problem of overflow during the initial influx of water, there was proposed a floating flap gate with a rope having a counterweight attached to one end, and with the other end connected to the door body via a pulley (e.g., Patent Reference 2).

The floating flap gate disclosed in Patent Reference 2 solves the problem of the delayed rising action of the door body during the initial influx of water by compensating for an insufficient buoyancy of the floating flap gate by using the weight of a counterweight.

However, the floating flap gate disclosed in Patent Reference 2 does not readily lower when the water level drops, because weight of the counterweight continually operates in a direction which assists in the operation of raising the door body.

Patent Reference 1: Japanese Patent Application Kokai Publication No. 2001-214425

Patent Reference 2: Japanese Patent Application Kokai Publication No. 2003-253912

SUMMARY OF THE INVENTION

Problems to be Solved by the Invention

The problem which the present invention aims to solve is that it becomes difficult to lower the door body when the water level drops, if a device is installed to continually assist in the operation of raising the door body, so as to solve the problem of a floating flap gate in which the operation of raising the door body is delayed when water starts flowing in, resulting an overflow into living spaces or underground spaces.

Means for Solving this Problem

The present invention was devised with the aim of eliminating the overflow into living spaces or into underground spaces when the raising operation of the door body is delayed when water first starts to flow in, and eliminating difficulty in lowering the door body when the water level drops, and thus eliminating hazardous behavior such as sudden falling of the door body.

The floating flap gate according to the present invention is a floating flap gate which is disposed at an opening or at an access way, so as to block the opening or the access way when water flows in, and comprises a door body with a forward end which is able to swing upwards, in a direction in which the water flows in and within a plane in a height direction, around a base end thereof serving as a fulcrum.

One end of a rope is attached to the forward end of the door body, and the other end of the rope is attached to a counterweight or a spring via at least a fixed pulley, so that the counterweight is at its lowest point or the spring reaches its natural length when the angle of inclination of the door body with respect to a horizontal plane reaches within a range from 10° to 80° during raising or lowering of the door body.

According to the present invention, the door body is assisted in rising by being drawn in an upward direction by the counterweight or by the spring, until the angle of inclination of the door body with respect to a horizontal plane reaches within a range from 10° to 80° during raising of the door body. Further, if the angle of inclination of the door body with respect to a horizontal plane exceeds the range of 10° to 80°, the counterweight or spring causes resistance, thereby reducing the raising speed of the door body.

On the other hand, when lowering the door body, until the angle of inclination of the door body with respect to a horizontal plane reaches within a range from 10° to 80°, the door body is assisted in following a downward trajectory which follows the water level as it drops, by being drawn in a downward direction by the counterweight or by the spring. In addition, when the angle of inclination of the door body with respect to a horizontal plane is below the range of 10° to 80°, the counterweight or spring causes resistance, thereby reducing the lowering speed of the door body.

Advantageous Effects of the Invention

According to the present invention, the predetermined angle of inclination of the door body with respect to a horizontal plane while raising or lowering the door body serves as a point of bifurcation for assisting in raising and lowering the door body and, causing resistance to raising or lowering the door body, thus making it possible to prevent water from overflowing at the time of the initial influx, and also making it possible to prevent the door from suddenly falling before lowering of the door body is completed. In addition, it becomes possible to mitigate the shock which occurs when raising of the door body is completed, and the ability of the door body to follow the water level improves at the initial stage of lowering of the door body.

BRIEF DESCRIPTION OF THE DRAWINGS

FIG. 6 (*a*) illustrates a case where the angle of inclination is 45°. FIG. 6 (*b*) illustrates cases where the angle of inclination is 0° and 90°. FIG. 6 (*c*) is a graph showing an example of the relationship between the angle of inclination of the door body and the swinging force of the door body in the direction of rising due to the spring of the floating flap gate according to the present invention.

FIG. 7 (*a*) illustrates a case where the angle of inclination is 45°. FIG. 7 (*b*) illustrates cases where the angle of inclination is 0° and 90°.

FIG. 11 (*a*) illustrates the initial stage of influx, and FIG. 11 (*b*) illustrates a time when the water level has dropped.

DETAILED DESCRIPTION OF THE PREFERRED EMBODIMENT

According to the present invention, the object of preventing an overflow of water, during a beginning of water inflow, into living spaces and underground spaces, preventing difficulties in lower the door body when the water level has dropped, and preventing the door body from suddenly falling, is achieved by assisting in raising and lowering the door body, and by causing resistance to raising or lowering the door body, by having the predetermined angle of inclination of the door body with respect to a horizontal plane serve as a point of bifurcation while raising and lowering the door body.

EXAMPLE

An example of the present invention is described in detail below using FIG. 1 to FIG. 10.

Figure 1:
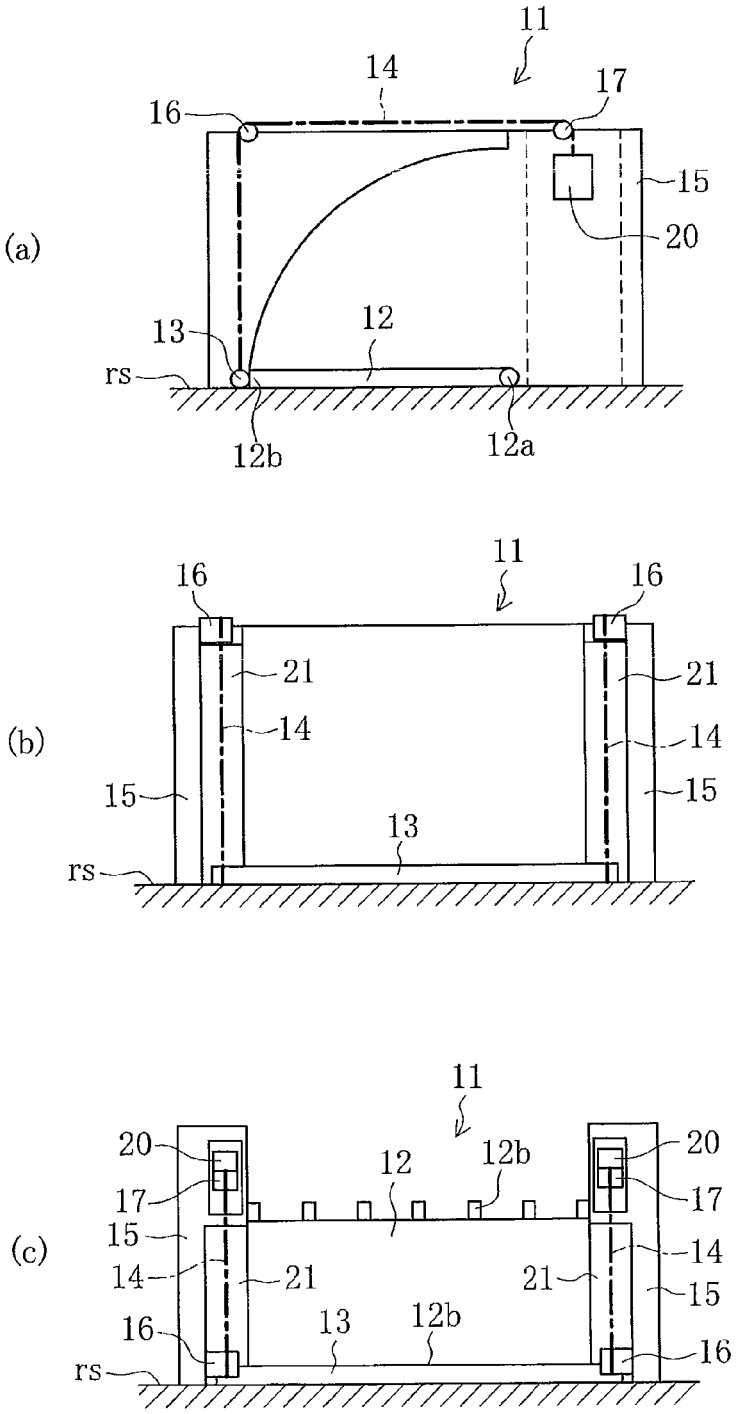
FIG. 1 is a schematic structural drawing of the floating flap gate according to the present invention, where FIG. 1 (*a*) is a side view, FIG. 1 (*b*) is a front view, and FIG. 1 (*c*) is a planar view.

FIG. 1 is a schematic structural drawing of the floating flap gate according to the present invention.

In FIG. 1, Reference Numeral 11 is a floating flap gate according to the present invention which is disposed on a channel surface rs at an opening in a seawall, for example. When a water w tries to flow from an ocean (or from a river) into a living space or an underground space, the floating flap gate 11 uses the pressure of the water w to swing a forward end 12*b* of a door body 12 upwards around a base end 12*a* as a fulcrum, to block the opening in a water-tight manner.

If there is a wide opening to be blocked by the door body 12 of the floating flap gate 11, then a plurality of door bodies 12 may be linked width-wise at the opening, and the spaces between the various door bodies 12 are joined together with water-tight rubber. In addition, water-tight rubber is provided on the sides corresponding to door bumpers of the door bodies 12 on both sides, which are provided at the opening of the seawall.

The floating flap gate 11 shown in FIG. 1 has, for example, a rod 13 attached across the entire width-wise direction of the forward end of the door body 12, which functions to support the load resulting from the water pressure, and to attach one end of a wire rope 14.

The other end of the wire rope 14 is attached to a counterweight 20 via a first fixed pulley 16 which is disposed at a door bumper 15 at the top of the forward end of the door body 12 during lowering, and via a second fixed pulley 17 disposed in a position at the same height as the first fixed pulley 16 on the base end side of the door body 12. Therefore, the weight of the counterweight 20 operates on the door body 12.

Figure 2:
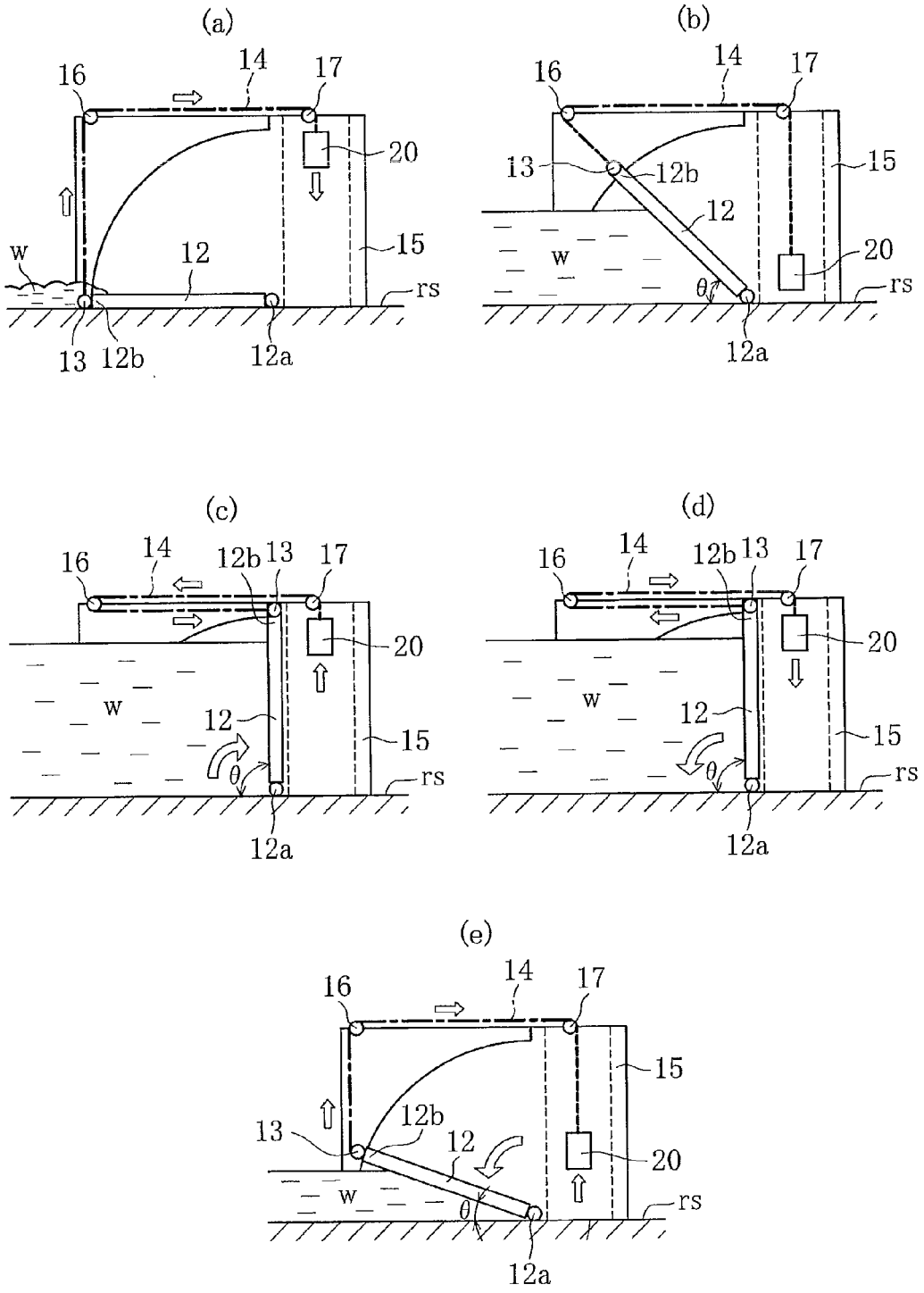
FIG. 2 is a drawing of the operating principle of the floating flap gate according to the present invention, where FIG. 2 (*a*) is an initial stage of influx of water, FIG. 2 (*b*) is an intermediate stage of raising or lowering, FIG. 2 (*c*) is a final stage of raising, FIG. 2 (*d*) is an initial stage of lowering, and FIG. 2 (*e*) is a final stage of lowering.

In the present example of the invention, because the angle of inclination θ of the door body 12 is 90° when raising of the door body is completed, the position at which the first fixed pulley 16 is set is such that the counterweight 20 reaches its lowest point when the angle of inclination θ is 45° with respect to a horizontal plane when the door body 12 swings upwards (see FIG. 2 (*b*)), for example. As a result of investigations conducted by the inventors, there was found to be no problem if the angle of inclination θ ranges from 10° to 80°.

The floating flap gate 11 of the present invention which has the above-described configuration exhibits the functions described below when raising and lowering the door body 12.

When Raising the Door Body 12

When water first starts flowing in, the counterweight 20 drops, pulling the door body 12 upwards, thereby assisting the door body 12 to rise (see FIG. 2 (*a*)). When the angle of inclination θ of the door body 12 with respect to a horizontal plane reaches 45°, the door body 12 and the wire rope 14 line up (see FIG. 2 (*b*)) and the counterweight 20 reaches the position of the lowermost end. When the angle of inclination θ of the door body 12 with respect to a horizontal plane exceeds 45°, the counterweight 20 rises due to the upwardly swinging action of the door body 12, so that the counterweight 20 causes resistance, thereby decelerating the rising of the door body 12, thus mitigating the shock when raising of the door body 12 is completed (see FIG. 2 (*c*)).

When Lowering the Door Body 12

At the initial stage of lowering the door body 12, the counterweight 20 drops, pulling the door body 12 downward so that it follows the water level as it drops (see FIG. 2 (*d*)). Further, when the angle of inclination θ of the door body 12 with respect to a horizontal plane reaches 45°, the door body 12 and the wire rope 14 line up (see FIG. 2 (*b*)) and the counterweight 20 reaches the position of the lowermost end. When the angle of inclination θ of the door body 12 with respect to a horizontal plane is less than 45°, the counterweight 20 rises due to the lowering of the door body 12, so that the counterweight 20 causes resistance, thereby decelerating the lowering of the door body 12, thus mitigating the shock when lowering of the door body 12 is completed (see FIG. 2 (*e*)).

Figure 3:
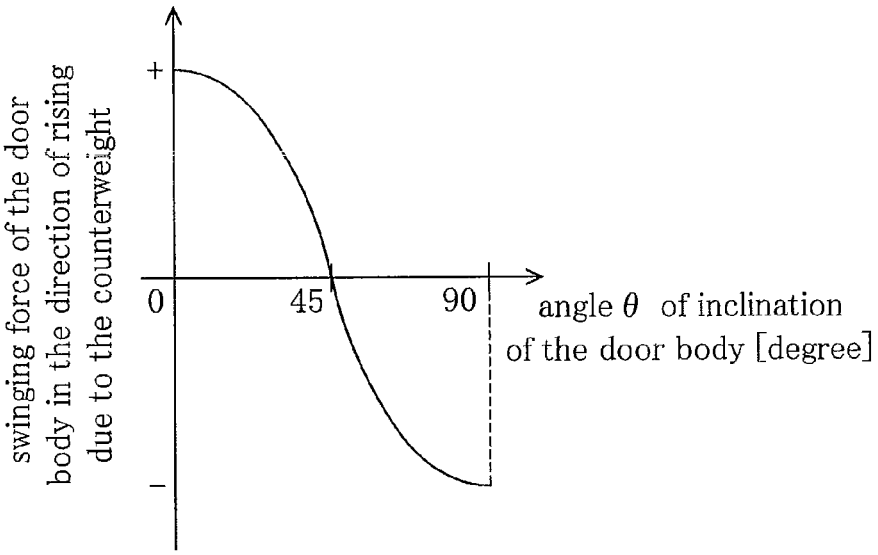
FIG. 3 is a drawing illustrating an example of the relationship between the angle of inclination of the door body and the swinging force of the door body in the direction of rising due to the counterweight in the floating flap gate according to the present invention.

FIG. 3 shows the relationship between the angle of inclination θ of the door body 12 and the swinging force of the door body 12 in the direction of rising due to the counterweight 20 in the floating flap gate 11 according to the present invention.

The floating flap gate 11 according to the present invention makes it possible to implement a variety of functions such as assisting in raising the door body 12, mitigating shock, and imparting a trajectory that follows the water level, as described above, by utilizing a raising/lowering mechanism which has the counterweight 20.

Figure 4:
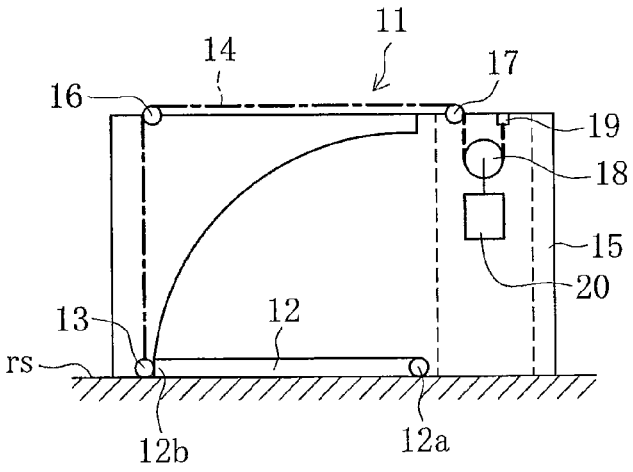
FIG. 4 is a schematic structural side view of the floating flap gate according to the present invention in a case where the counterweight is in contact with a movable pulley.

As shown in FIG. 4, the floating flap gate 11 according to the present invention may have a movable pulley 18 arranged behind the second fixed pulley 17, and while the counterweight 20 is attached to the movable pulley 18, the other end of the wire rope 14 may be secured to a securing member 19 disposed at the door bumper 15 via the movable pulley 18.

Figure 5:
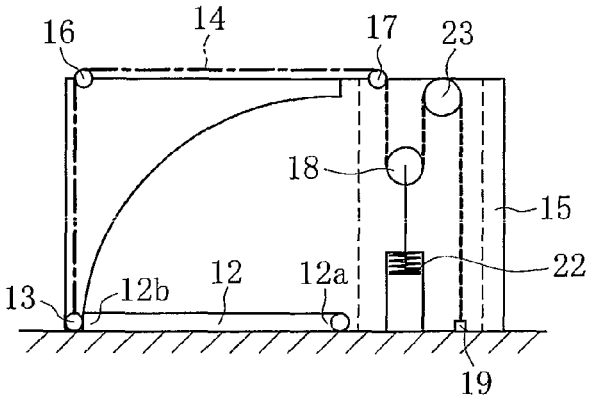
FIG. 5 is a schematic structural side view of the floating flap gate according to the present invention, using a linear compression coil spring instead of a counterweight.

As shown in FIG. 5, the floating flap gate 11 according to the present invention may have a compression pressure coil spring 22 attached, instead of the counterweight 20. A tension coil spring may be attached, although it is not shown in the drawing. Reference Numeral 23 in FIG. 5 is a third fixed pulley which is disposed between the movable pulley 18 and the securing member 19. The compression coil spring 22 or the tension coil spring may come in direct contact with the other end of the wire rope 14 as shown in FIG. 1 and FIG. 2, instead of having the movable pulley 18 disposed between them, as shown in FIG. 5.

Figure 6:
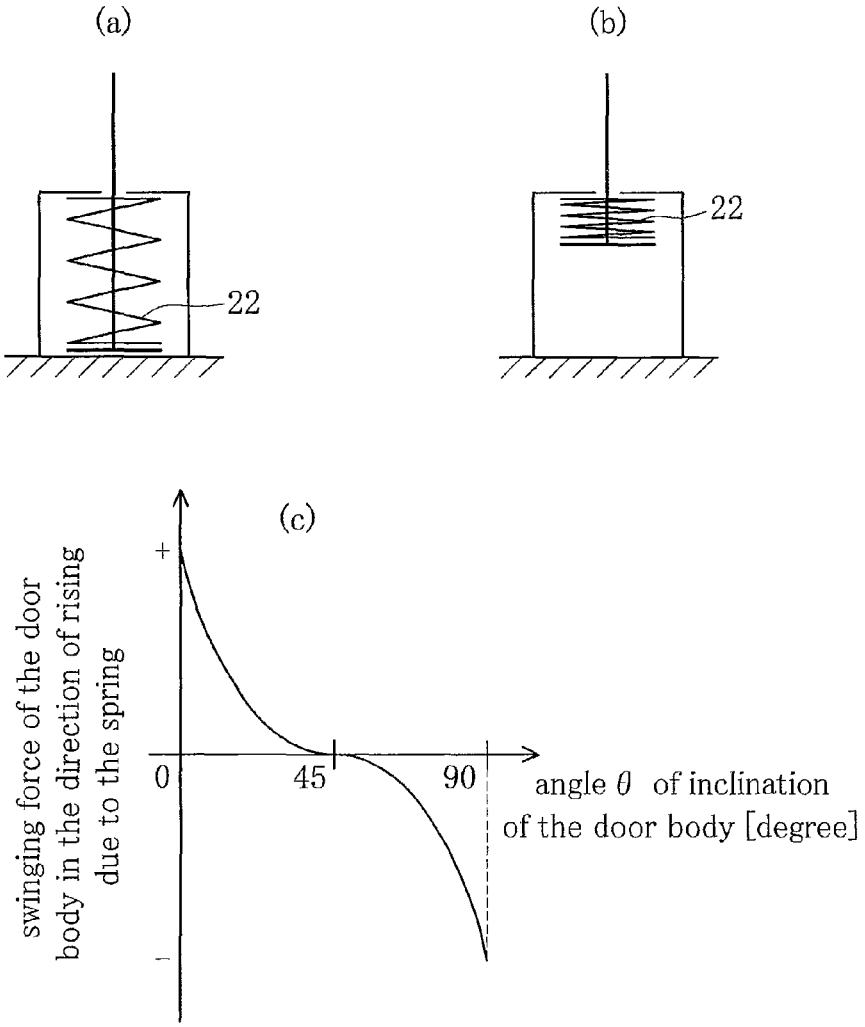
FIGS. 6 (*a*) and 6 (*b*) are drawings illustrating the operating state of the linear compression coil spring with respect to the angle of inclination of the door body.

If the compression coil spring 22 is used, in the case of a flap gate having a door body 12 with an angle of inclination θ of 90° when raising of the door body 12 is completed, the spring reaches its natural length as shown in FIG. 6 (*a*) when the angle of inclination θ of the door body 12 is 45°, and, as shown in FIG. 6 (*c*), the swinging force of the door body in the direction of rising is set to reach a minimum by means of the spring. Further, when the angle of inclination θ of the door body 12 is 0° and 90°, the spring is compressed as shown in FIG. 6 (*b*), and the swinging force of the door body in the direction of rising is set to reach a maximum by means of the spring, as shown in FIG. 6 (*c*).

Figure 7:
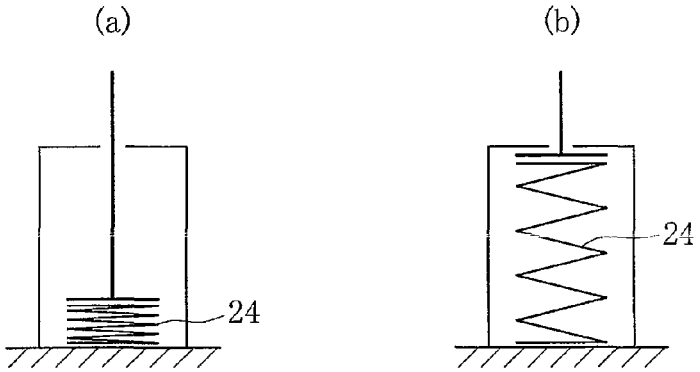
FIG. 7 shows drawings illustrating the operating state of linear tension coils with respect to the angle of inclination of the door body.

On the other hand, if a tension coil spring 24 is used, the spring reaches its natural length as shown in FIG. 7 (*a*) when the angle of inclination θ is 45°, and when the angle of inclination θ is 0° and 90°, the spring becomes extended, as shown in FIG. 7 (*b*).

The compression coil spring 22 or the tension coil spring 24 is not limited to the linear coil spring as shown in FIG. 6 or FIG. 7. A spring which has non-linear properties such as a taper coil spring, a conical coil spring, a cylindrical coil spring, a barrel-shaped spring, or an irregular pitch coil spring may be used.

Figure 8:
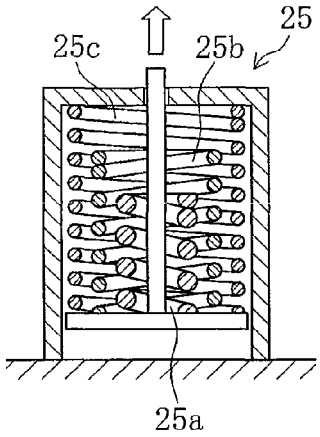
FIG. 8 is a drawing illustrating a non-linear combination coil spring.

As shown in FIG. 8, a combination coil spring 25 formed from a large-diameter and short-length first compression spring 25*a*, a medium-diameter and medium-length second compression spring 25*b*, and a small-diameter and long-length third compression spring 25*c* arranged sequentially from the central axis, may be used to produce a tensile force which is non-linear.

When the combination coil spring 25 shown in FIG. 8 is used, and the angle of inclination θ of the door body 12 is 0°, the three compression springs 25*a*-25*c* are all in a state of compression. Further, from the initial stage of rising to the early stage of rising of the door body 12, when the angle of inclination of the door body 12 is about 10-30°, the three compression springs 25*a*-25*c* each start to expand, and when the early stage of rising is reached, the first compression spring 25*a* returns to its original state.

Next, from the early stage of rising to the intermediate stage of rising when the angle of inclination θ of the door body 12 is 45°, the second compression spring 25*b* and the third compression spring 25*c* successively return to their original state, and the three compression springs 25*a*-25*c* all return to their natural length.

From the intermediate stage of rising to the completion of rising when the angle of inclination θ of the door body 12 is 90°, the third compression spring 25*c*, the second compression spring 25*b*, and the first compression spring 25*a* successively contract, and when raising of the door body 12 is completed, the three compression springs 25*a*-25*c* are all in a compressed state.

When lowering the door body, the state is the reverse of that for when raising the door body.

Figure 9:
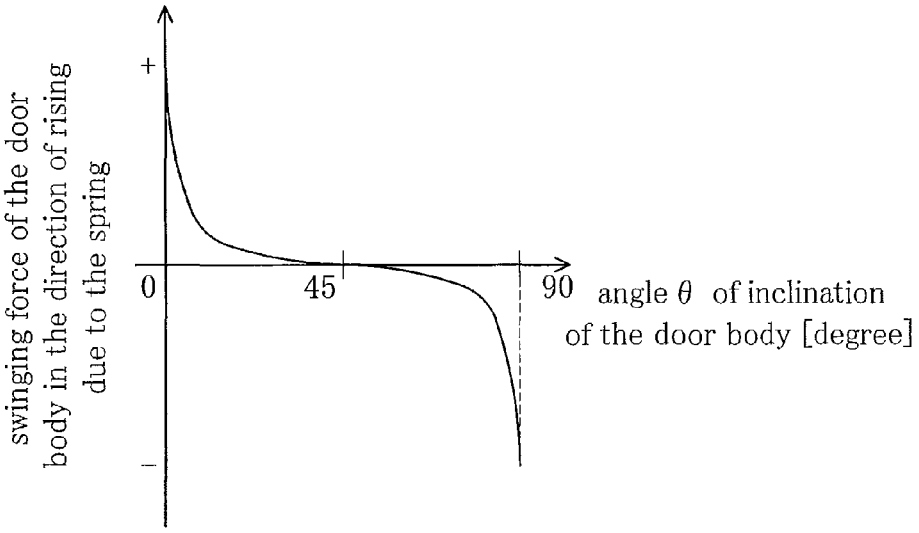
FIG. 9 is a graph illustrating another example of the relationship between the angle of inclination of the door body and the swinging force of the door body in the direction of rising due to the spring of the floating flap gate according to the present invention.

FIG. 9 shows the relationship between the angle of inclination θ of the door body 12 and the swinging force of the door body in the direction of rising due to the non-linear combination coil spring 25.

Figure 10:
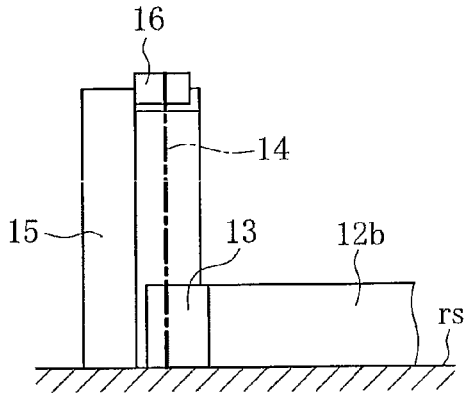
FIG. 10 is a drawing illustrating a portion of the floating flap gate according to the present invention corresponding to a portion where the rod is attached to both sides of the door body.
Figure 11:
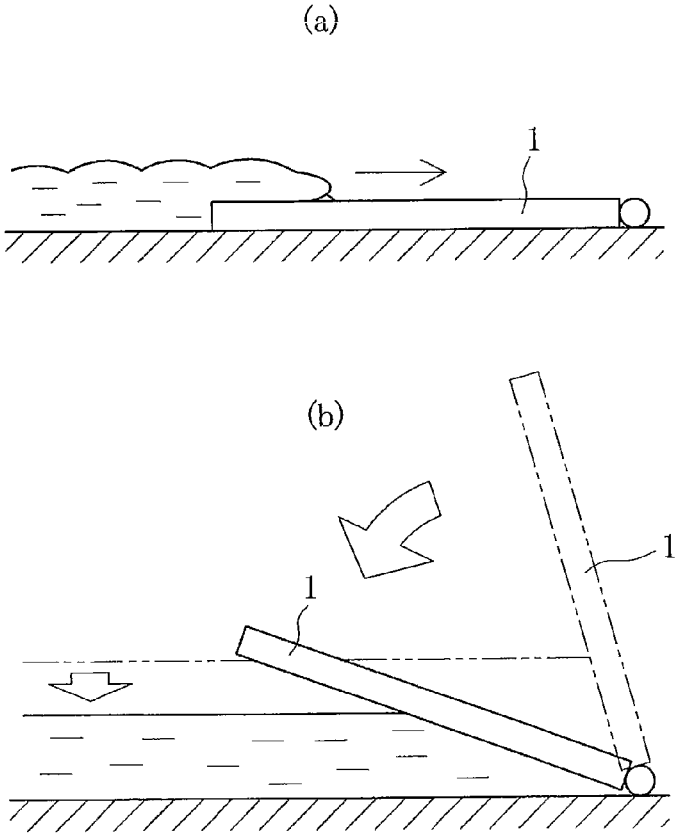
FIG.11 Prior Art
FIG. 11 shows drawings illustrating the problems of the floating flap gate according to the prior art.

FIG. 1, FIG. 2, FIG. 4, and FIG. 5 show examples in which a single rod 13 is attached across the entire width of the door body 12, but in FIG. 10, the rod 13 may be attached only to both sides of the door body 12.

The present invention is not limited to the above-described example, and the preferred embodiment may, of course, be advantageously modified within the scope of the technical ideas recited in the claims.

For example, the wire rope 14 was used in the above example, but a polyamide-series, polyester-series, polyethylene-series, polypropylene-series, aramid-series, polyarylate-series, or ultra-high density synthetic fiber rope may be used.

FIG. 1, FIG. 2, FIG. 4, and FIG. 5 show a floating flap gate in which the door body 12 is a single floating body, but floating body connection-type flap gate may be used, in which a plurality of floating bodies are connected in a direction of height.

The movable pulley 18, the counterweight 20, and the springs 22, 24, and 25 may be attached at a position on the outside of the door bumper 15, but the weight of the counterweight 20, the number of fixed pulleys 16, 17 and movable pulleys 18, and the characteristics of the springs 22, 24, 25 may, of course, be set at the most appropriate values depending on the size of the door body 12.

Moreover, instead of attaching the rod 13, a hanging piece may be attached to the forward end of the door body 12, and one end of the wire rope 14 may be attached to the hanging piece.

EXPLANATION OF THE REFERENCE NUMERALS

11 Floating flap gate
12 Door body
13 Rod
14 Wire rope
16 First fixed pulley
17 Second fixed pulley
18 Movable pulley
20 Counterweight
22 Compression coil spring
24 Tension coil spring
25 Combined coil spring

What is claimed is:

1. A floating flap gate which is disposed at an opening or at an access way and comprises:

a door body which is solid having front surface and a back surface, the door body having a top end and a bottom end, wherein the bottom end serves as a fulcrum hinge which allows the solid door body to swing in an incline or a decline direction with an arc swinging movement corresponding to a rise or a drop in water level contacting the front surface of the door body, wherein the arc swinging movement of the door body raises or lowers the door body according to the water level which keeps water from flowing into the opening or the access way facing the back surface of the door body, wherein an angle of inclination of 90 degrees or less is formed between the front surface of the door body and a horizontal reference plane located at the water level, wherein the angle of inclination indicates how high the water level which contacts the front surface of the door body has reached, wherein an angle of inclination greater than 0 degrees indicates that the floating flap gate is at least partially closed, and wherein the floating flap gate further comprises:

a rope with one end attached to the top end of the door body, and another end of the rope attached to a counterweight suspended in the air via fixed pulleys to facilitate the arc swinging movement of the door body, wherein the counterweight reaches its lowest vertical height from ground when the angle of inclination of the door body with respect to the horizontal reference plane is within a range between 10° to 80° during the arc swinging movement of the door body, wherein:

a deviation of the vertical height of the counterweight from its lowest vertical height from the ground assists in speeding up or dampening the arc swinging movement of the door body in response to the rise or drop in the water level which keeps water from flowing into the opening or the access way, wherein the more the counterweight vertical height deviates from its lowest vertical height from the ground, the more the counterweight assists in the speeding up or dampening the arc swinging movement, wherein when the counterweight reaches its lowest vertical height from the ground, the counterweight assists the least in the speeding up or dampening the arc swinging movement, and wherein the counterweight reaches its lowest vertical height from the ground when the floating flap gate is at a halfway open or halfway closed position providing minimal assistance to speeding up or dampening the arc swinging movement.

2. A floating flap gate disposed at an opening or at an access way for blocking water from flowing in through the opening or the access way, the floating flap gate comprising:

a door body which is solid having a front surface and back surface, the door body having a top end and a bottom end, wherein the bottom end serves as a fulcrum hinge which allows the enclosed door body to swing in an incline or a decline direction with an arc swinging movement corresponding to a rise or a drop in water level contacting the front surface of the door body, wherein the arc swinging movement of the door body raises or lowers the door body according to the water level which keeps water from flowing into the opening or the access way facing the back surface of the door body, wherein an angle of inclination of 90 degrees is formed between the front surface of the door body and a horizontal reference plane located at the water level, wherein the angle of inclination indicates how high the water level which contacts the front surface of the door body has reached, the angle of inclination at 0° indicating the floating flap gate being fully opened and the angle of inclination at 90° indicating the floating flap gate has been added after being fully closed, wherein an angle of inclination greater than 0 degrees indicates that the floating flap gate is at least partially closed, and wherein the floating flap gate further comprises:

a rope with one end attached to the top end of the door body, and another end of the rope attached to a spring via fixed pulleys to facilitate the arc swinging movement of the door body, wherein the spring reaches its natural length achieving minimal tension or minimum compression when the angle of inclination of the door body with respect to the horizontal reference plane is within a range between 10° to 80° during the arc swinging movement of the door body, wherein:

a deviation of the spring from its natural length assists in speeding up or dampening the arc swinging movement of the door body in response to the rise or drop in the water level which keeps water from flowing into the opening or the access way, wherein the more the spring deviates from its natural length due to tension or compression, the more the spring assists in the speeding up or dampening the arc swinging movement, wherein when the spring reaches its natural length, the spring assists the least in the speeding up or dampening the arc swinging movement, and wherein the spring reaches its natural length free from tension or compression when the floating flap gate is at a halfway open or halfway closed position providing minimal assistance to speeding up or dampening the arc swinging movement.

* * * * *